US011271323B2

(12) United States Patent
Takahashi

(10) Patent No.: US 11,271,323 B2
(45) Date of Patent: Mar. 8, 2022

(54) RADIO COMMUNICATION APPARATUS

(71) Applicant: NEC Corporation, Tokyo (JP)

(72) Inventor: Yoshihide Takahashi, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/042,546

(22) PCT Filed: Feb. 6, 2019

(86) PCT No.: PCT/JP2019/004310

§ 371 (c)(1),
(2) Date: Sep. 28, 2020

(87) PCT Pub. No.: WO2019/187675

PCT Pub. Date: Oct. 3, 2019

(65) Prior Publication Data

US 2021/0210864 A1 Jul. 8, 2021

(30) Foreign Application Priority Data

Mar. 29, 2018 (JP) ..... JP2018-064147

(51) Int. Cl.
*H01Q 21/00* (2006.01)
*H01P 5/107* (2006.01)
*H01Q 13/10* (2006.01)

(52) U.S. Cl.
CPC ..... *H01Q 21/005* (2013.01); *H01P 5/107* (2013.01); *H01Q 13/106* (2013.01); *H01Q 21/0062* (2013.01)

(58) Field of Classification Search
CPC ..... H01Q 21/005; H01Q 21/0062; H01Q 21/064; H01Q 13/106; H01Q 3/36
See application file for complete search history.

(56) References Cited

U.S. PATENT DOCUMENTS 5,165,109 A * 11/1992 Han ..... H01Q 9/0435 343/700 MS
8,279,131 B2 * 10/2012 Puzella ..... H01Q 21/00 343/853

(Continued)

FOREIGN PATENT DOCUMENTS

JP 06-291536 A 10/1994
JP 11-239017 A 8/1999

(Continued)

OTHER PUBLICATIONS

International Search Report of PCT/JP2019/004310 dated Apr. 23, 2019 [PCT/ISA/210].

(Continued)

*Primary Examiner* — Lam T Mai
(74) *Attorney, Agent, or Firm* — Sughrue Mion, PLLC

(57) ABSTRACT

A radio communication apparatus includes a printed board, an RF circuit formed on one surface of the printed board and configured to generate an RF signal, a first transmission line configured to transmit the RF signal, a second transmission line configured to transmit a signal different from the RF signal, and an antenna formed on another surface of the printed board and configured to emit the RF signal. The antenna includes a plurality of dielectric substrates layered on the other surface of the printed board, a metal film formed on surfaces of the plurality of dielectric substrates, and a through hole formed in at least the dielectric substrate adjacent to the printed board. The first transmission line is disposed on the one surface of the printed board, and a part of the second transmission line is disposed between any of the plurality of layered dielectric substrates.

14 Claims, 5 Drawing Sheets

(56) References Cited

U.S. PATENT DOCUMENTS

| | | | | |
|---|---|---|---|---|
| 2005/0068251 | A1* | 3/2005 | Ebling | H01Q 25/007 343/911 L |
| 2008/0218418 | A1* | 9/2008 | Gillette | H01Q 13/18 343/700 MS |
| 2010/0033393 | A1* | 2/2010 | Myszne | H01Q 9/285 343/793 |
| 2012/0299783 | A1* | 11/2012 | Lee | H01Q 1/2291 343/700 MS |
| 2013/0335281 | A1* | 12/2013 | Dokai | G06K 19/07722 343/748 |
| 2015/0029068 | A1* | 1/2015 | Toyao | H01Q 13/106 343/770 |
| 2017/0153332 | A1* | 6/2017 | Wallace | H01Q 25/02 |
| 2018/0255634 | A1* | 9/2018 | Tong | H05K 1/0274 |
| 2020/0212537 | A1* | 7/2020 | Chuang | H01Q 9/0407 |
| 2020/0328529 | A1* | 10/2020 | Rogers | H01Q 19/06 |
| 2020/0381819 | A1* | 12/2020 | Weinstein | H01Q 1/528 |
| 2021/0265734 | A1* | 8/2021 | Toyao | H01Q 9/42 |
| 2021/0296771 | A1* | 9/2021 | Sano | H01Q 3/28 |

FOREIGN PATENT DOCUMENTS

| | | | |
|---|---|---|---|
| JP | 2003-017909 | A | 1/2003 |
| JP | 2009-038696 | A | 2/2009 |

OTHER PUBLICATIONS

Written Opinion of PCT/JP2019/004310 dated Apr. 23, 2019 [PCT/ISA/237].

* cited by examiner

RADIO COMMUNICATION APPARATUS

CROSS REFERENCE TO RELATED APPLICATIONS

This application is a National Stage of International Application No. PCT/JP2019/004310 filed on Feb. 6, 2019, claiming priority based on Japanese Patent Application No. 2018-064147 filed Mar. 29, 2018, the disclosure of which is incorporated herein in its entirely by reference.

TECHNICAL FIELD

The present disclosure relates to a radio communication apparatus. The present disclosure relates to, for example, a radio communication apparatus suitable for transmitting and receiving high-quality RF (Radio Frequency) signals.

BACKGROUND ART

A phased array antenna includes at least a plurality of phase shifters for adjusting a phase of a reference RF signal to generate a plurality of RF signals, a control circuit for controlling phase shift amounts of the respective phase shifters, and a plurality of antennas for emitting the phase-adjusted plurality of RF signals into the air.

Recently, in a phased array antenna, it has been desired to integrally form an RF circuit and a plurality of antennas on one printed board. The RF circuit here includes a plurality of phase shifters and a control circuit for controlling the phase shift amounts of the phase shifters. By integrally forming the RF circuit and the plurality of antennas on one printed board, a cable and a waveguide for connecting the RF circuit to the plurality of antennas become unnecessary, so that the circuit size can be reduced and transmission loss of the RF signal in a transmission path can also be reduced.

In order to integrally form an RF circuit and a plurality of antennas on one printed board, planar antennas called patch antennas may be used as the plurality of antennas to form the antennas. However, the patch antenna has a problem that the bandwidth is narrow and the transmission loss of the RF signal in the transmission path is still large.

A solution to such a problem is disclosed in Patent Literature 1. Patent Literature 1 discloses a configuration of an antenna formed using a multilayer wiring board. The antenna having this configuration can transmit and receive an RF signal having a bandwidth wider than that of an RF signal transmitted and received by the patch antenna.

CITATION LIST

Patent Literature

Patent Literature 1: Japanese Unexamined Patent Application Publication No. H11-239017

SUMMARY OF INVENTION

Technical Problem

However, Patent Literature 1 does not disclose how an RF circuit integrally formed with antennas on one printed board is formed in detail. For this reason, there is a problem that the quality of the RF signal deteriorates due to a transmission loss of the RF signal in the transmission path depending on how the RF circuit is formed.

An object of the present disclosure is to provide a radio communication apparatus that solves the above problem.

Solution to Problem

An example aspect is a radio communication apparatus including: a printed board; an RF circuit formed on one surface of the printed board and configured to generate an RF signal; a first transmission line configured to transmit the RF signal; a second transmission line configured to transmit a signal different from the RF signal; and an antenna formed on another surface of the printed board and configured to emit the RF signal supplied from the RF circuit through the first transmission line. The antenna includes: a plurality of dielectric substrates layered on the other surface of the printed board; a metal film formed on surfaces of the plurality of dielectric substrates; and a through hole formed in the plurality of dielectric substrates. The first transmission line is disposed from the RF circuit to an area facing the through hole on the one surface of the printed board, and a part of the second transmission line is disposed between the plurality of layered dielectric substrates.

Another example aspect is a radio communication apparatus including: a printed board; an RF circuit formed on one surface of the printed board and configured to generate a plurality of RF signals; a plurality of first transmission lines configured to transmit a plurality of RF signals; a plurality of second transmission lines configured to transmit a plurality of signals different from the plurality of RF signals; and a plurality of antennas formed on another surface of the printed board and configured to emit the plurality of RF signals supplied from the RF circuit through the plurality of first transmission lines, respectively. Each of the plurality of antennas includes: a plurality of dielectric substrates layered on the other surface of the printed board; a metal film formed on surfaces of the plurality of dielectric substrates; and a through hole formed in the plurality of dielectric substrates. Each of the plurality of first transmission lines is disposed from the RF circuit to an area facing the through hole on the one surface of the printed board, and a part of each of the plurality of second transmission lines is disposed between any of the plurality of layered dielectric substrates.

Advantageous Effects of Invention

According to the above example aspects, it is possible to provide a radio communication apparatus capable of transmitting and receiving a high-quality RF signal.

DESCRIPTION OF EMBODIMENTS

Hereinafter, example embodiments will be described with reference to the drawings. Since the drawings are simplified, the technical scope of the example embodiments should not be narrowly interpreted on the basis of the description of the drawings. The same elements are denoted by the same reference signs, and repeated descriptions are omitted.

The disclosure will be described by dividing it into a plurality of sections or example embodiments whenever circumstances require it for convenience in the following embodiments. However, unless otherwise particularly specified, these sections or embodiments are not irrelevant to one another. One section or example embodiment is related to modified example, applications, details, supplementary explanations, and the like of some or all of the other ones. When reference is made to the number of elements or the like (including the number of pieces, numerical values, quantity, range, etc.) in the following example embodiments, the number thereof is not limited to a specific number and may be greater than or less than or equal to the specific number unless otherwise particularly specified and definitely limited to the specific number in principle.

Further, in the following example embodiments, components (including operation steps, etc.) are not always essential unless otherwise particularly specified and considered to be definitely essential in principle. Similarly, when reference is made to the shapes, positional relations, or the like of the components or the like in the following example embodiments, they will include ones, for example, substantially approximate or similar in their shapes or the like unless otherwise particularly specified and considered not to be definitely so in principle. This is similarly applied even to the above-described number or the like (including the number of pieces, numerical values, quantity, range, etc.).

First Example Embodiment

Figure 1:
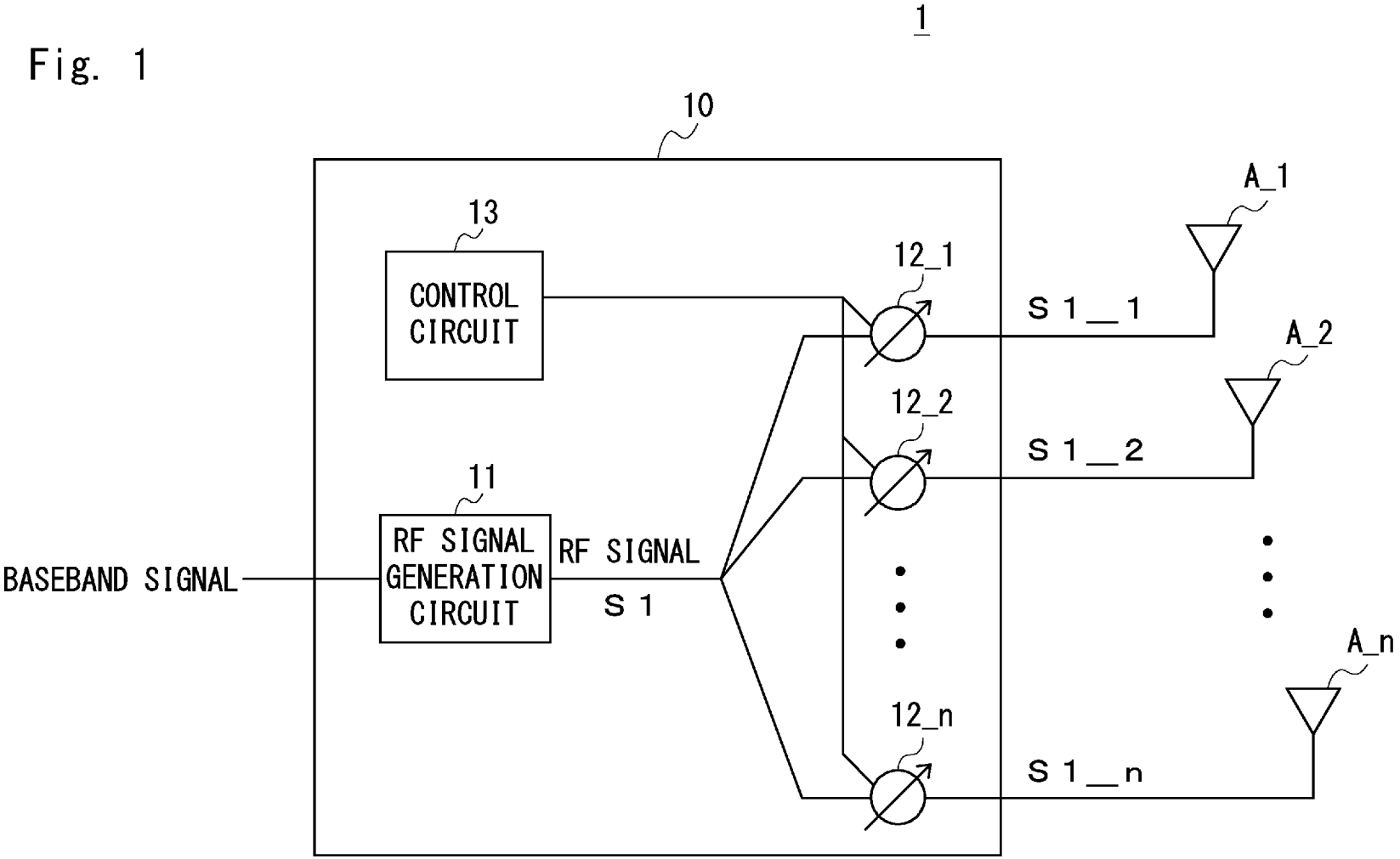
FIG. 1 is a block diagram showing a configuration example of a radio communication apparatus according to a first example embodiment.

FIG. 1 is a block diagram showing a configuration example of a radio communication apparatus 1 according to a first example embodiment.

As shown in FIG. 1, a radio communication apparatus 1 includes at least an RF circuit 10 and a plurality of antennas A_1 to A_n (n is an integer greater than or equal to 2). The RF circuit 10 includes at least an RF signal generation circuit 11, a plurality of phase shifters 12_1 to **12_*n*, and a control circuit 13**.

The RF signal generation circuit 11 modulates a baseband signal or an intermediate signal thereof (IF signal) into a high frequency RF signal S1 using a local signal (LO signal) from a local oscillator. The phase shifters 12_1 to **12_*n* adjust the phase of the RF signal S1 generated by the RF signal generation circuit 11 and outputs a plurality of RF signals S1_1 to S1_*n*, respectively. The control circuit 13 controls the respective phase shift amounts of the plurality of phase shifters 12_1 to 12_*n*. The plurality of RF signals S1_1 to S1_*n* are emitted into the air from antennas A_1 to A_n, respectively. By controlling the phases of the plurality of RF signals S1_1 to S1_*n*, the radio communication apparatus 1 can provide the RF signal S1** with directivity.

The RF signals S1_1 to S**1_*n* transmitted and received through the antennas A_1 to A_n are millimeter waves of a specific band in a range of, for example, 26 GHz to 110 GHz. Specifically, the RF signals S1_1 to S1_*n* are millimeter waves in a band from 60 GHz to 90 GHz (E band). Alternatively, the RF signals S1_1 to S1_*n*** are any of millimeter waves in the *band from* 26 GHz to 40 GHz (Ka band), millimeter waves in the band from 50 GHz to 70 GHz (V band), and millimeter waves in the band from 75 GHz to 110 GHz (W band). When the RF signals S1_1 to S**1_*n* of such a high frequency band are transmitted and received, it is particularly important to reduce the transmission loss of the RF signals S1_1 to S1_*n* in the transmission lines from the RF circuit 10 to the plurality of antennas A_1** to A_n.

Preliminary Study by the Inventor

First, radio communication apparatuses 51 and 61 which have been studied in advance by the present inventor will be described before explaining a configuration of the radio communication apparatus 1 described above.

Cross-Sectional Structure of Radio Communication Apparatus 51

Figure 4:
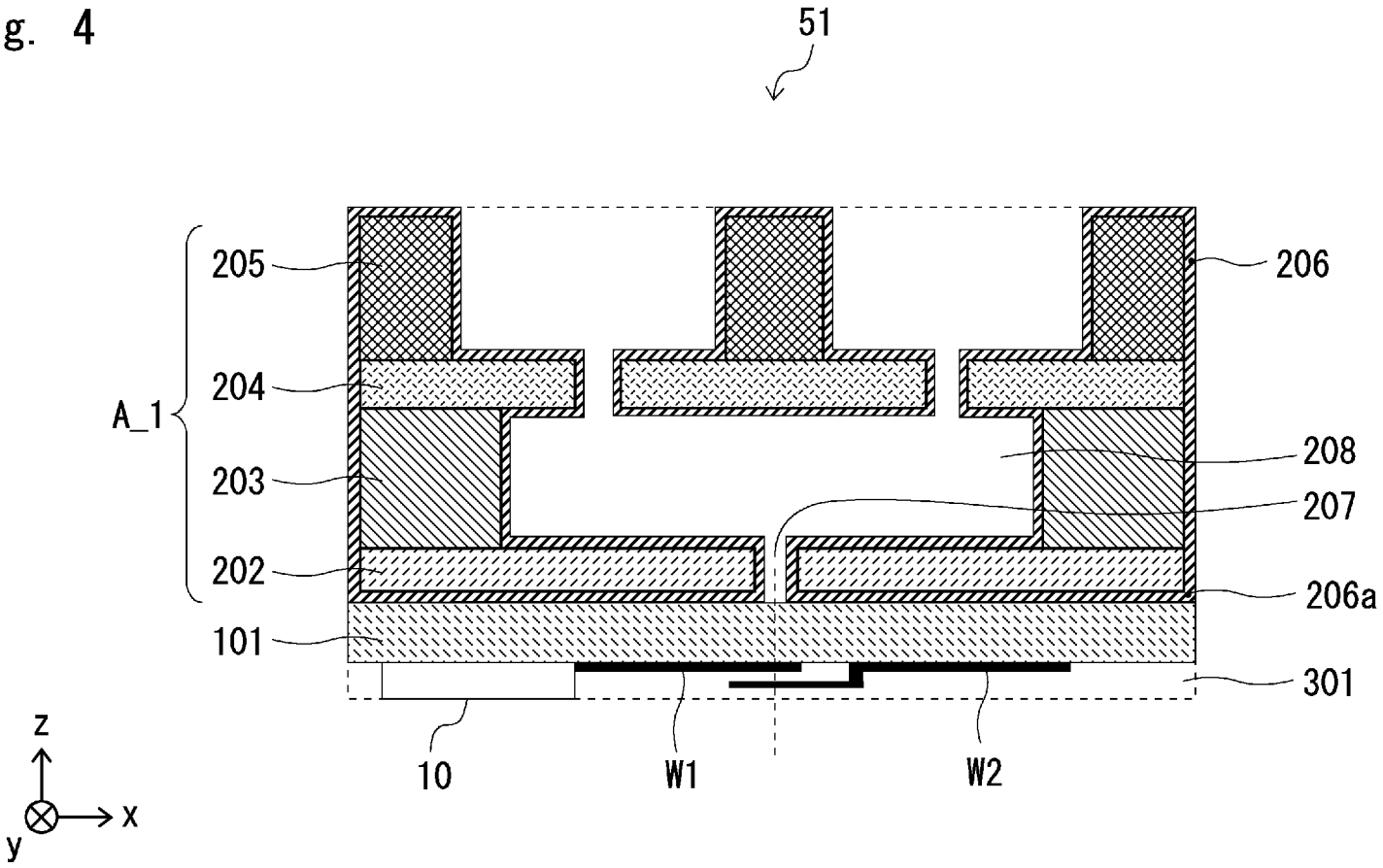
FIG. 4 is a block diagram showing a configuration example of a radio communication apparatus according to a concept before conceiving the first example embodiment.

FIG. 4 is a schematic cross-sectional view of a radio communication apparatus 51 according to a concept before conceiving the first example embodiment.

As shown in FIG. 4, the radio communication apparatus 51 includes at least a printed board 101, an RF circuit 10, a transmission line W1, a transmission line W2, and antennas A_1 to A_n. In the example of FIG. 4, only the antenna A_1 is shown as a representative of the plurality of antennas A_1 to A_n.

In the radio communication apparatus 51, the RF circuit 10 and the antennas A_1 to A_n are integrally formed on one printed board 101. Then, in the radio communication apparatus 51, it becomes unnecessary to connect the RF circuit 10 to the antennas A_1 to A_n by a cable or a waveguide, so that the circuit size can be reduced, and the transmission loss in the transmission line can also be reduced.

The RF circuit 10 such as an MMIC (Monolithic Microwave Integrated Circuit) is provided in an RF circuit formation layer 301 on one main surface of the printed board 101. The transmission line W1 for transmitting the RF signal S1_1 is wired to the RF circuit formation layer 301. The transmission line W1 is wired in the RF circuit formation layer 301 from the RF circuit 10 to an area facing a through hole 207 of the antenna A_1. In other words, the transmission line W1 is wired in the RF circuit formation layer 301 from the RF circuit 10 to the through hole 207 of the antenna A_1 when the printed board 101 is viewed in the z-axis direction. Further, the transmission line W2 for transmitting signals other than the RF signal S1_1 such as an LO signal, an IF signal, and a power supply voltage is wired to the RF circuit formation layer 301.

The antenna A_1 composed of a plurality of dielectric substrates 202 to 205 and a metal film 206 is formed on the other main surface of the printed board 101.

More specifically, the plurality of dielectric substrates 202 to 205 are layered on the other main surface of the printed board 101. The plurality of dielectric substrates 202 to 205 may be glass substrates for general use or substrates made of the same material as that of the printed board 101.

Among the layered dielectric substrates 202 to 205, the through hole 207 serving as a waveguide is formed in the dielectric substrate 202 disposed adjacent to the printed board 101. In the dielectric substrates 203 to 205, a space area 208 continuous to the through hole 207 is formed. Further, the metal film 206 is formed by performing a plating treatment on the surfaces of the plurality of layered dielectric substrates 202 to 205. In the metal film 206, a metal film **206*a* formed between the printed board 101 and the dielectric substrate 202 forms a ground layer (hereinafter also referred to as a ground layer 206***a*) of the antenna A_1 and the RF circuit 10.

The RF signal S1_1 generated by the RF circuit 10 is supplied to the antenna A_1 through the transmission line W1. The RF signal S1_1 propagates through the through hole 207 serving as a waveguide and reaches the space area 208 of the antenna A_1, and then is emitted into the air.

The antennas A_2 to A_n (not shown) have the same cross-sectional structure as that of the antenna A_1, and thus the descriptions of the antennas A_2 to A_n will be omitted.

The antenna having the cross-sectional structure shown in FIG. 4 can transmit (or receive) an RF signal having a bandwidth wider than that of an RF signal transmitted and received by the patch antenna. Further, in the antenna having the cross-sectional structure shown in FIG. 4, unlike the patch antenna, no surface wave mode is generated, and thus the influence of mutual coupling can be reduced.

However, in the structure of the radio communication apparatus 51 shown in FIG. 4, only one layer of the RF circuit formation layer 301 is present, and thus it is necessary to use a special wiring structure when the transmission lines are wired in an intersecting manner. Consequently, there is a problem that the level of difficulty in manufacturing is increased, and the manufacturing cost is increased.

Therefore, the present inventor has studied a radio communication apparatus 61.

Cross-Sectional Structure of Radio Communication Apparatus 61

Figure 5:
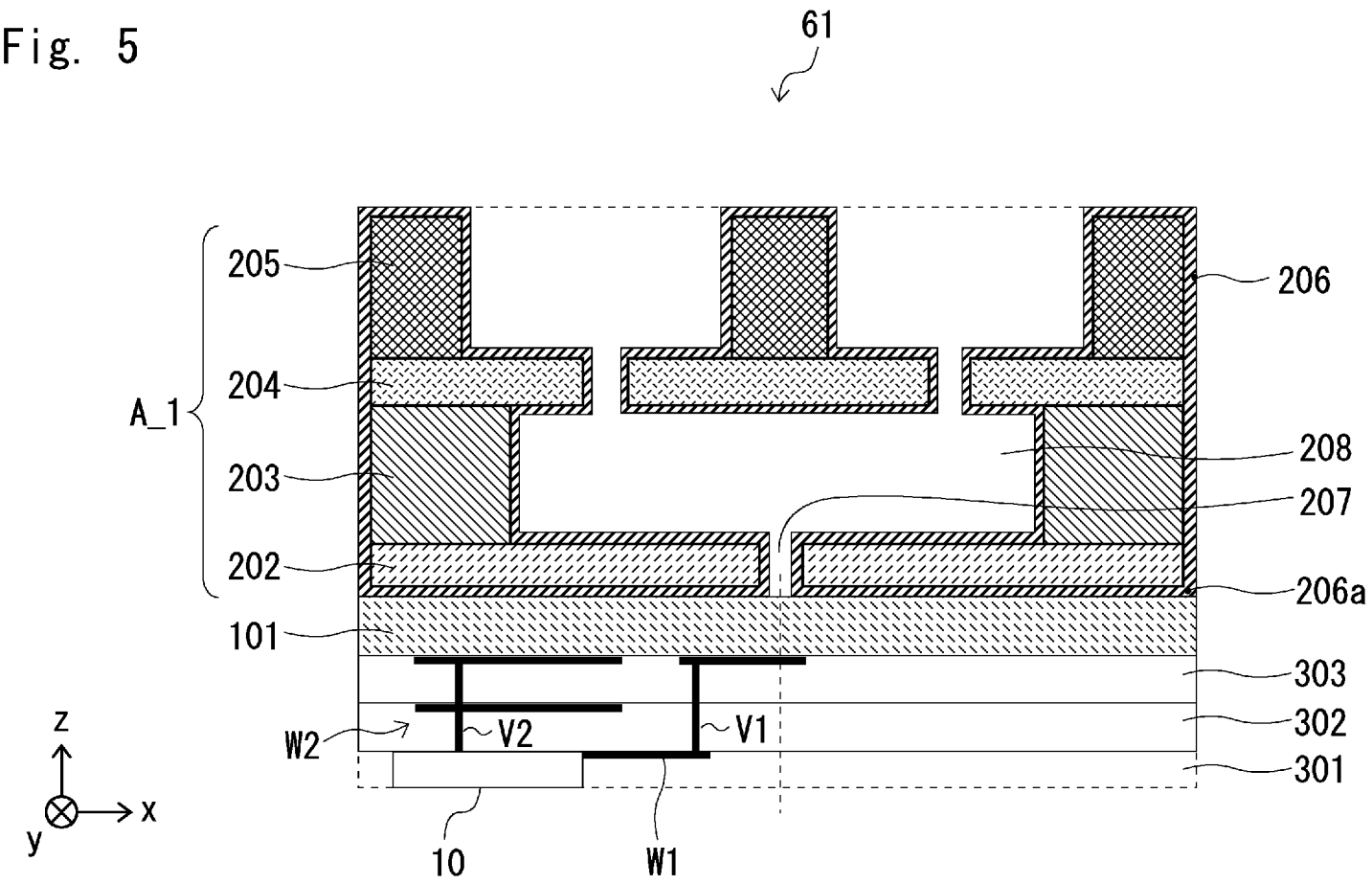
FIG. 5 is a block diagram showing a configuration example of a radio communication apparatus according to a concept before conceiving the first example embodiment.

FIG. 5 is a schematic cross-sectional view of a radio communication apparatus 61 according to a concept before conceiving the first example embodiment.

As shown in FIG. 5, the radio communication apparatus 61 includes a plurality of RF circuit formation layers in addition to the components of the radio communication apparatus 51.

Specifically, the RF circuit formation layers 301 to 303 are provided on one main surface of the printed board 101. The RF circuit 10 is formed in the RF circuit formation layer 301. In the RF circuit formation layers 302 and 303, a part of the transmission line W1 for transmitting the RF signal S1_1 is wired through a via V1, and a part of the transmission line W2 for transmitting signals other than the RF signal S1_1 such as an LO signal, an IF signal and a power supply voltage is wired through a via V2.

In the structure of the radio communication apparatus 61 shown in FIG. 5, it is not necessary to use a special wiring structure to wire the transmission lines in an intersecting manner, so that the level of difficulty in manufacturing is reduced, and the manufacturing cost is reduced.

However, in the structure of the radio communication apparatus 61 shown in FIG. 5, the via V1 is included in a part of the transmission line W1 wired from the RF circuit 10 to the area facing the through hole 207 of the antenna A_1 (through-hole 207 of the antenna A_1 when the printed board 101 is viewed in the z-axis direction). This increases the transmission loss of the RF signal S1_1 in the transmission line W1. Thus, there has been a problem that the radio communication apparatus 61 cannot transmit (or receive) the high-quality RF signal S1_1. For the same reason, there has been a problem that the radio communication apparatus 61 cannot transmit (or receive) high-quality RF signals S1_2 to S1_*n*. In particular, when the RF signals S1_1 to S1_*n* are millimeter waves in a high frequency band, the influence of the transmission loss due to the via V1 cannot be ignored.

Furthermore, in the structure of the radio communication apparatus 61 shown in FIG. 5, the thickness of a dielectric between the ground layer 206*a* and the formation layer 301 of the RF circuit 10 increases due to an increase in the number of layers of the RF circuit formation layer, thereby increasing the level of difficulty in designing.

In order to address such an issue, the present inventor has found the radio communication apparatus 1 according to the first example embodiment that can transmit (or receive) a high-quality RF signal without increasing the number of layers of an RF circuit formation layer by forming a transmission line using a metal film between a plurality of dielectric substrates constituting an antenna.

Figure 2:
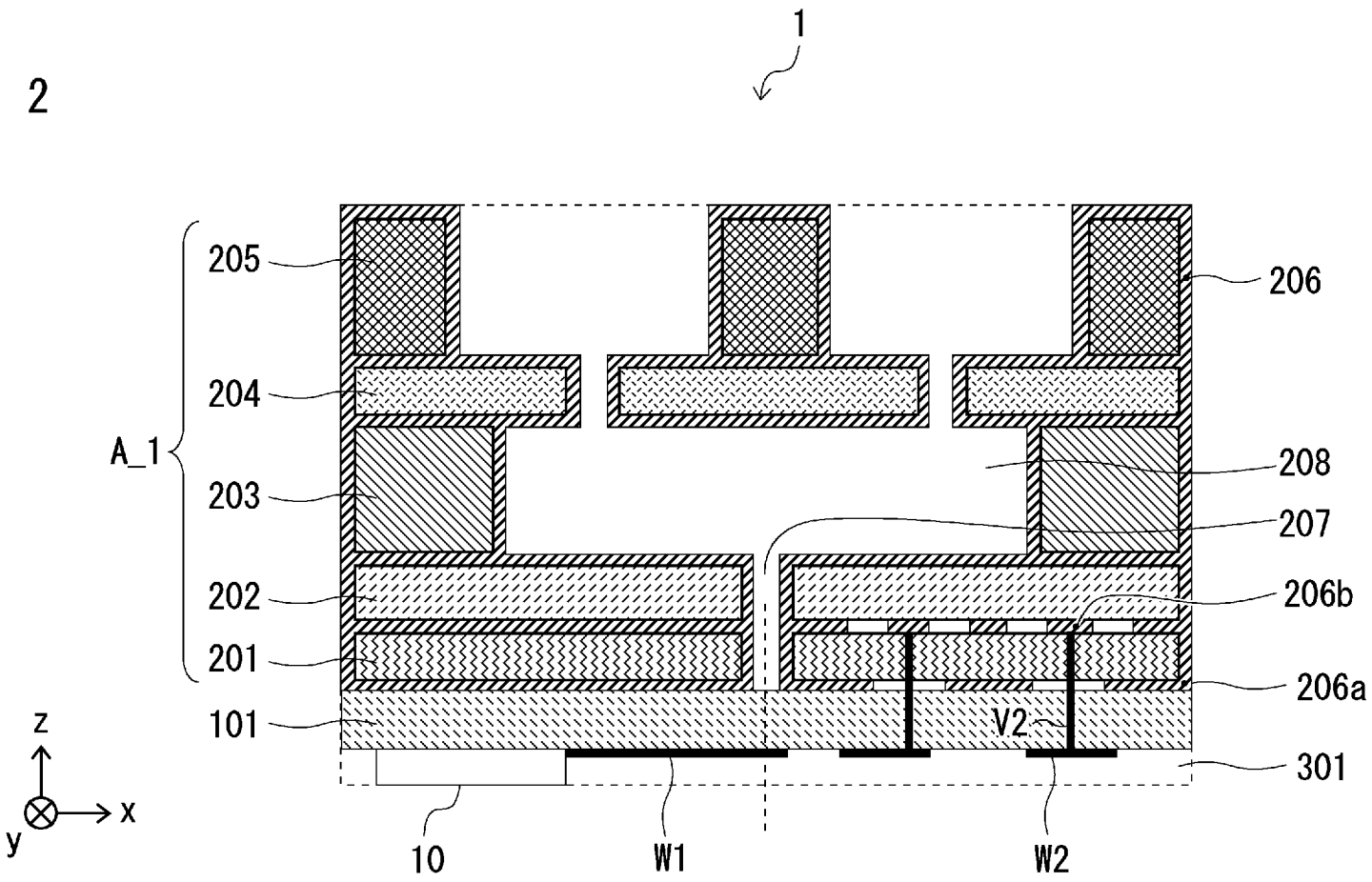
FIG. 2 is a schematic cross-sectional view of the radio communication apparatus according to the first example embodiment of the present disclosure.

Cross-sectional Structure of Radio Communication Apparatus 1 According to the First Example Embodiment FIG. 2 is a schematic cross-sectional view of the radio communication apparatus 1 according to the first example embodiment.

As shown in FIG. 2, the radio communication apparatus 1 includes at least the printed board 101, the RF circuit 10, the transmission line W1, the transmission line W2, and the antennas A_1 to A_n. In the example of FIG. 1, only the antenna A_1 is shown as a representative of the plurality of antennas A_1 to A_n.

In the radio communication apparatus 1, the RF circuit 10 and the antennas A_1 to A_n are integrally formed on one printed board 101. Then, in the radio communication apparatus 1, it becomes unnecessary to connect the RF circuit 10 to the antennas A_1 to A_n by a cable or a waveguide, so that the circuit size can be reduced, and the transmission loss in the transmission line can also be reduced.

The RF circuit 10 such as an MMIC is provided in an RF circuit formation layer 301 provided on one main surface of a printed board 101. The transmission line W1 for transmitting the RF signal S1_1 is wired to the RF circuit formation layer 301. The transmission line W1 is wired in the RF circuit formation layer 301 from the RF circuit 10 to an area facing a through hole 207 of the antenna A_1. In other words, the transmission line W1 is wired in the RF circuit formation layer 301 from the RF circuit 10 to the through hole 207 of the antenna A_1 when the printed board 101 is viewed in the z-axis direction. Further, a part of the transmission line W2 for transmitting signals other than the RF signal S1_1 such as an LO signal, an IF signal, and a power supply voltage is wired to the RF circuit formation layer 301.

The antenna A_1 composed of a plurality of dielectric substrates 201 to 205 and the metal film 206 is formed on the other main surface of the printed board 101.

More specifically, the plurality of dielectric substrates 201 to 205 are layered on the other main surface of the printed board 101. The plurality of dielectric substrates 201 to 205 may be glass substrates for general use or substrates made of the same material as that of the printed board 101.

Among the layered dielectric substrates 201 to 205, the through hole 207 serving as a waveguide is formed in the dielectric substrates 201 and 202 disposed adjacent to the printed board 101. In the dielectric substrates 203 to 205, the space area 208 continuous to the through hole 207 is formed. Further, the metal film 206 such as a thin copper film is formed by performing a plating treatment on each of the surfaces of the plurality of layered dielectric substrates 201 to 205. In the metal film 206, the metal film 206*a* formed between the printed board 101 and the dielectric substrate 201 forms a ground layer (hereinafter also referred to as a ground layer 206*a*) of the antenna A_1 and the RF circuit 10.

The RF signal S1_1 generated by the RF circuit 10 is supplied to the antenna A_1 through the transmission line W1. The RF signal S1_1 propagates through the through hole 207 serving as a waveguide and reaches the space area 208 of the antenna A_1, and then is emitted into the air.

The antennas A_2 to A_n (not shown) have the same cross-sectional structure as that of the antenna A_1, and thus the descriptions of the antennas A_2 to A_n will be omitted.

Figure 3:
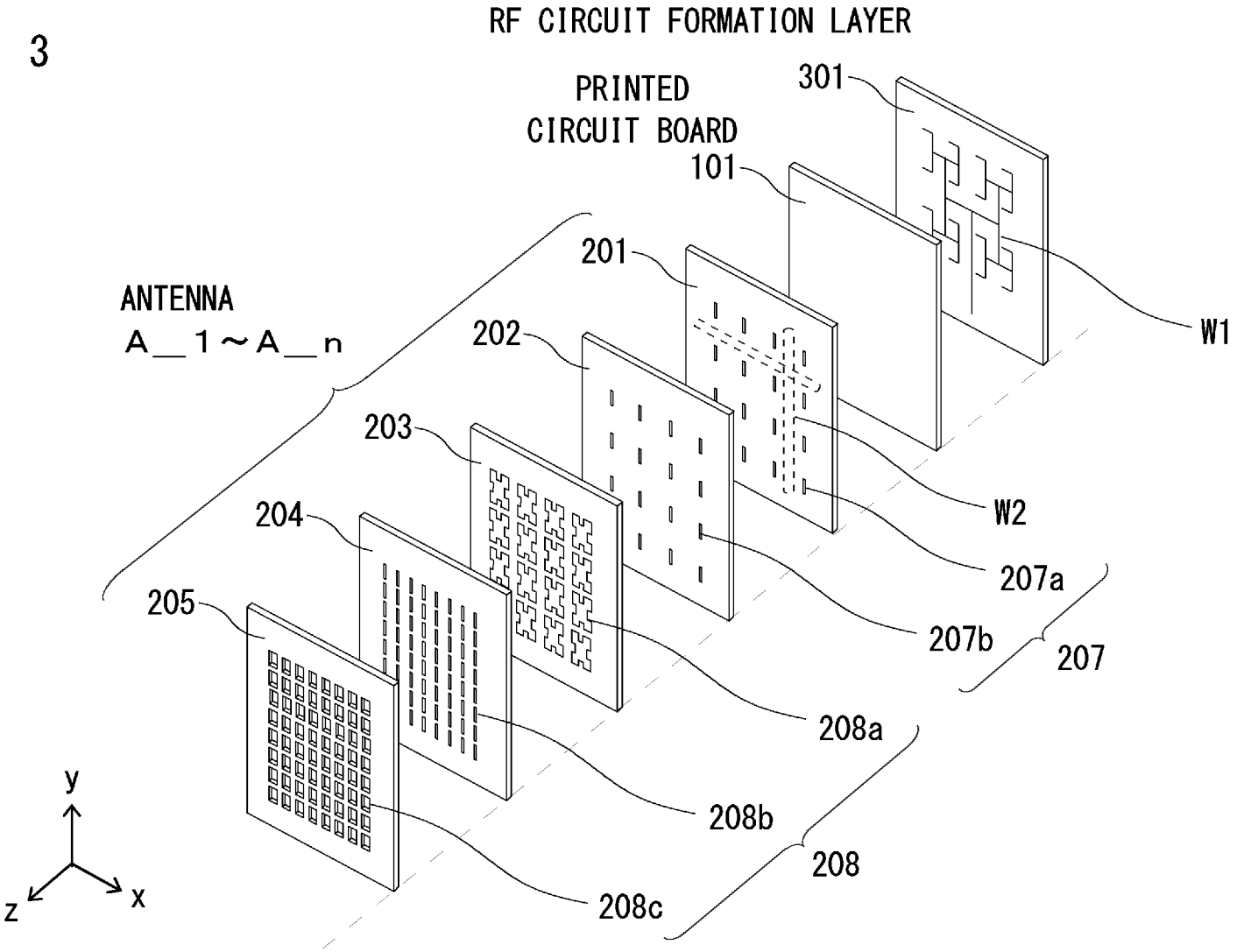
FIG. 3 is a diagram for explaining each layer of the radio communication apparatus shown in FIG. 2.

FIG. 3 is a diagram showing the radio communication apparatus 1 shown in FIG. 2 divided into layers.

As shown in FIG. 3, slit patterns 207*a* and 207*b* corresponding to the plurality of through holes 207 are formed in the dielectric substrates 201 and 202, respectively. Slit patterns 208*a*, 208*b*, and 208*c* corresponding to the plurality of space areas 208 are formed in the dielectric substrate 203 to 205, respectively.

Further, the metal film 206 is formed on each of the surfaces of the dielectric substrates 201 to 205. To be more specific, the metal film 206 is formed on each of the surfaces of the dielectric substrates 201 to 205 by performing a plating treatment on each of the surfaces of the dielectric substrates 201 to 205 before the dielectric substrates 201 to 205 are layered.

Here, the transmission line W1 for transmitting the RF signal S1_1 is wired to the RF circuit formation layer 301. On the other hand, the transmission line W2 for transmitting signals other than the RF signal S1_1 such as an LO signal, an IF signal, and a power supply voltage is not only wired to the RF circuit formation layer 301 but also wired using the metal film 206 (hereinafter referred to as the metal film 206*b*) formed between the dielectric substrates 201 and 202. Note that the transmission line W2 wired between the dielectric substrates 201 and 202 are formed by performing a plating treatment while the dielectric substrate is masked with the mask pattern of the transmission line W2 when the metal film 206*a* is formed between the dielectric substrates 201 and 202. For example, signals other than the RF signal S1_1 such as an LO signal, an IF signal, and a power supply voltage are transmitted from the transmission line W2 formed in the RF circuit formation layer 301 to the transmission line W2 formed by the metal film 206*b* between the dielectric substrates 201 and 202 through the via V2.

Thus, in the radio communication apparatus 1, the transmission lines W1 and W2 can be wired without increasing the number of layers of the RF circuit formation layer 301. As a result, the transmission line W1 can be wired from the RF circuit 10 right under the through hole 207 of the antenna A_1 without using the via V1, and therefore the RF signal S1_1 is maintained in a high quality state.

In the radio communication apparatus 1, since it is not necessary to use a special wiring structure for wiring in an intersecting manner, the level of difficulty in designing is reduced, and the manufacturing cost is reduced.

As described above, in the radio communication apparatus 1 according to this example embodiment, the transmission line W2 other than the transmission line W1 for transmitting RF signals is formed between the plurality of dielectric substrates, which are components of the antenna, using the metal film provided between the plurality of dielectric substrates. By doing so, in the radio communication apparatus 1 according to this example embodiment, it is not necessary to increase the number of layers of the RF circuit formation layer, so that the transmission line W1 for transmitting the RF signal can be wired without using a via. As a result, the radio communication apparatus 1 according to this example embodiment can transmit (or receive) high-quality RF signals.

In this example embodiment, an example in which a part of the transmission line W2 is formed using the metal film 206*b* between the dielectric substrates 201 and 202 has been described, but the present disclosure is not limited to this case. A part of the transmission line W2 can be formed by using any metal film 206*b* between the dielectric substrates 201 to 205.

In this example embodiment, a case where the metal film 206 is formed on each surface of the dielectric substrate 201 to 205 before the dielectric substrate 201 to 205 are layered has been described as an example, but the present disclosure is not limited to this case. The metal film 206 may be formed only on an exposed surface of the dielectric substrates 201 to 205 after the dielectric substrates 201 to 205 are layered. In this case, the metal film 206*b* is formed by performing a plating treatment only between the dielectric substrates for wiring the transmission line W2 among the plurality of dielectric substrates while the dielectric substrate is masked by the mask pattern of the transmission line W2.

In this example embodiment, a case where the plurality of antennas A_1 to A_n are provided on the printed board 101 has been described as an example, but the present disclosure is not limited to this case. The case where one antenna A_1 is provided on the printed board 101 is included in the scope of the present disclosure as a matter of course.

In this example embodiment, the case where the RF signals S1_1 to S1_*n* are transmitted from the plurality of antennas A_1 to A_n has been described as an example, but the present disclosure is not limited to this case. The case where the RF signals S1_1 to S1_*n* are received by the plurality of antennas A_1 to A_n, respectively, is also included in the scope of the present disclosure as a matter of course.

Although the present disclosure has been described with reference to the example embodiments, the present disclosure is not limited by the above. The configuration and details of the present disclosure may be modified in various ways as will be understood by those skilled in the art within the scope of the disclosure.

This application is based upon and claims the benefit of priority from Japanese patent application No. 2018-064147, filed on Mar. 29, 2018, the disclosure of which is incorporated herein in its entirety by reference.

REFERENCE SIGNS LIST

1 RADIO COMMUNICATION APPARATUS
10 RF CIRCUIT
11 RF SIGNAL GENERATION CIRCUIT
12_1 TO 12_*n* PHASE SHIFTER
13 CONTROL CIRCUIT
101 PRINTED BOARD
201 TO 205 DIELECTRIC SUBSTRATE
206 METAL FILM
206*a* METAL FILM
206*b* METAL FILM
207 THROUGH HOLE
207*a*, 207*b* SLIT PATTERN
208 SPACE AREA
208*a*, 208*b*, 208*c* SLIT PATTERN
301 RF CIRCUIT FORMATION LAYER
302 RF CIRCUIT FORMATION LAYER
303 RF CIRCUIT FORMATION LAYER
A_1 TO A_n ANTENNA

W1 TRANSMISSION LINE
W2 TRANSMISSION LINE
V1 VIA
V2 VIA

The invention claimed is:

1. A radio communication apparatus comprising:
a printed board;
an RF circuit formed on one surface of the printed board and configured to generate an RF signal;
a first transmission line configured to transmit the RF signal;
a second transmission line configured to transmit a signal different from the RF signal; and
an antenna formed on another surface of the printed board and configured to emit the RF signal supplied from the RF circuit through the first transmission line, wherein the antenna comprises:
a plurality of dielectric substrates layered on the other surface of the printed board;
a metal film formed on surfaces of the plurality of dielectric substrates; and
a through hole formed in at least the dielectric substrate adjacent to the printed board from among the plurality of dielectric substrates,
the first transmission line is disposed from the RF circuit to an area facing the through hole on the one surface of the printed board, and
a part of the second transmission line is disposed between any of the plurality of dielectric substrates.

2. The radio communication apparatus according to claim 1, wherein
the part of the second transmission line is formed using a part of the metal film formed between the plurality of dielectric substrates.

3. The radio communication apparatus according to claim 1, wherein
the plurality of dielectric substrates are formed of glass substrates.

4. The radio communication apparatus according to claim 1, wherein
the plurality of dielectric substrates are formed of the same material as that of the printed board.

5. The radio communication apparatus according to claim 1, wherein
the signal different from the RF signal is any of a signal before it is modulated into the RF signal, a local signal used for modulating the RF signal, and a power supply voltage.

6. The radio communication apparatus according to claim 1, wherein
the RF signal is a millimeter wave in a band of 26 GHz to 110 GHz.

7. The radio communication apparatus according to claim 1, wherein
the RF signal is a millimeter wave in a band of 60 GHz to 90 GHz.

8. A radio communication apparatus comprising:
a printed board;
an RF circuit formed on one surface of the printed board and configured to generate a plurality of RF signals;
a plurality of first transmission lines configured to transmit a plurality of RF signals;
a plurality of second transmission lines configured to transmit a plurality of signals different from the plurality of RF signals; and
a plurality of antennas formed on another surface of the printed board and configured to emit the plurality of RF signals supplied from the RF circuit through the plurality of first transmission lines, respectively, wherein each of the plurality of antennas comprises:
a plurality of dielectric substrates layered on the other surface of the printed board;
a metal film formed on surfaces of the plurality of dielectric substrates; and
a through hole formed in the plurality of dielectric substrates,
each of the plurality of first transmission lines is disposed from the RF circuit to an area facing the through hole on the one surface of the printed board, and
a part of each of the plurality of second transmission lines is disposed between any of the plurality of dielectric substrates.

9. The radio communication apparatus according to claim 8, wherein
the part of each of the plurality of second transmission lines is formed using a part of the metal film formed between the plurality of dielectric substrates.

10. The radio communication apparatus according to claim 8, wherein
the plurality of dielectric substrates are formed of glass substrates.

11. The radio communication apparatus according to claim 8, wherein
the plurality of dielectric substrates are formed of the same material as that of the printed board.

12. The radio communication apparatus according claim 8, wherein
the plurality of signals different from the RF signals are any of a signal before it is modulated into the RF signal, a local signal used for modulating the RF signal, and a power supply voltage.

13. The radio communication apparatus according to claim 8, wherein
the RF signal is a millimeter wave in a band of 26 GHz to 110 GHz.

14. The radio communication apparatus according to claim 8, wherein
the RF signal is a millimeter wave in a band of 60 GHz to 90 GHz.

* * * * *